US010271650B2

(12) United States Patent
Ebersole

(10) Patent No.: US 10,271,650 B2
(45) Date of Patent: Apr. 30, 2019

(54) SUPPORT FOR WIRE SHELF AND METHOD OF USE

(71) Applicant: The Invention Club, LLC, Mechanicsburg, PA (US)

(72) Inventor: Jonathan Scott Ebersole, Mechanicsburg, PA (US)

(73) Assignee: The Invention Club, LLC, Mechanicsburg, PA (US)

( * ) Notice: Subject to any disclaimer, the term of this patent is extended or adjusted under 35 U.S.C. 154(b) by 0 days.

(21) Appl. No.: 15/532,606

(22) PCT Filed: Sep. 9, 2016

(86) PCT No.: PCT/US2016/050937
§ 371 (c)(1),
(2) Date: Jun. 2, 2017

(87) PCT Pub. No.: WO2017/069862
PCT Pub. Date: Apr. 27, 2017

(65) Prior Publication Data

US 2017/0367481 A1 Dec. 28, 2017

Related U.S. Application Data

(60) Provisional application No. 62/243,451, filed on Oct. 19, 2015.

(51) Int. Cl.

| | |
|---|---|
| ***A47F 5/00*** | (2006.01) |
| ***A47B 96/06*** | (2006.01) |
| *A47B 97/00* | (2006.01) |

(52) U.S. Cl.
CPC ..... *A47B 96/06* (2013.01); *A47B 97/00* (2013.01)

(58) Field of Classification Search
CPC ..... A47B 55/02; A47B 96/061; A47B 96/06; A47B 96/024; A47B 96/063
USPC ..... 248/215, 249, 304; 211/90.01, 90.03
See application file for complete search history.

(56) References Cited

U.S. PATENT DOCUMENTS

| | | | | |
|---|---|---|---|---|
| D352,195 | S | 11/1994 | Rogers et al. | |
| D354,864 | S | 1/1995 | Kokenge et al. | |
| 5,405,026 | A | 4/1995 | Lee et al. | |
| 5,531,416 | A | 7/1996 | Remmers | |
| 5,580,018 | A * | 12/1996 | Remmers | A47B 55/02 108/152 |
| 5,758,851 | A | 6/1998 | Remmers | |
| 5,910,351 | A | 6/1999 | Davis et al. | |
| D419,344 | S | 1/2000 | Greene | |
| 6,024,333 | A | 2/2000 | Raasch et al. | |
| 6,364,266 | B1 | 4/2002 | Garvin | |
| 6,969,036 | B2 | 11/2005 | Magnusson | |
| 7,004,335 | B2 | 2/2006 | Remmers | |
| D527,559 | S | 9/2006 | Remmers | |
| 7,185,772 | B2 | 3/2007 | Remmers | |
| D569,715 | S * | 5/2008 | Fernandez | D8/377 |
| 7,516,930 | B2 | 4/2009 | Chen | |
| 7,726,619 | B2 | 6/2010 | Lien | |
| D621,244 | S | 8/2010 | Kundinger, Jr. et al. | |

(Continued)

*Primary Examiner* — Steven M Marsh
(74) *Attorney, Agent, or Firm* — Hooker & Habib, P.C.

(57) ABSTRACT

A support adapted for mounting to wire shelving units, particularly a support adapted to be securely coupled and repositioned on upper and lower horizontally-extending wire members located at the front of wire shelving units.

20 Claims, 10 Drawing Sheets

(56) References Cited

U.S. PATENT DOCUMENTS

| | | | | |
|---|---|---|---|---|
| 7,900,783 | B2 * | 3/2011 | Fernandez | A47B 45/00 108/108 |
| 7,946,549 | B2 | 5/2011 | Forrest et al. | |
| 8,152,005 | B2 | 4/2012 | Barkdoll et al. | |
| 8,308,116 | B2 | 11/2012 | Daniels | |
| 8,453,984 | B2 | 6/2013 | Best et al. | |
| 8,646,624 | B2 * | 2/2014 | Fernandez | A47B 45/00 108/108 |
| 9,345,343 | B2 * | 5/2016 | Sobb | A47F 5/0823 |
| 2005/0230577 | A1 | 10/2005 | Chen | |
| 2006/0011570 | A1 | 1/2006 | Chen | |
| 2006/0231516 | A1 | 10/2006 | Moore | |
| 2009/0152424 | A1 * | 6/2009 | Forrest | A47B 96/06 248/304 |
| 2012/0068032 | A1 | 3/2012 | Stockman | |
| 2015/0053632 | A1 | 2/2015 | Brinton, Jr. et al. | |
| 2015/0265069 | A1 * | 9/2015 | Brinton, Jr. | A47B 96/02 211/119.003 |

* cited by examiner

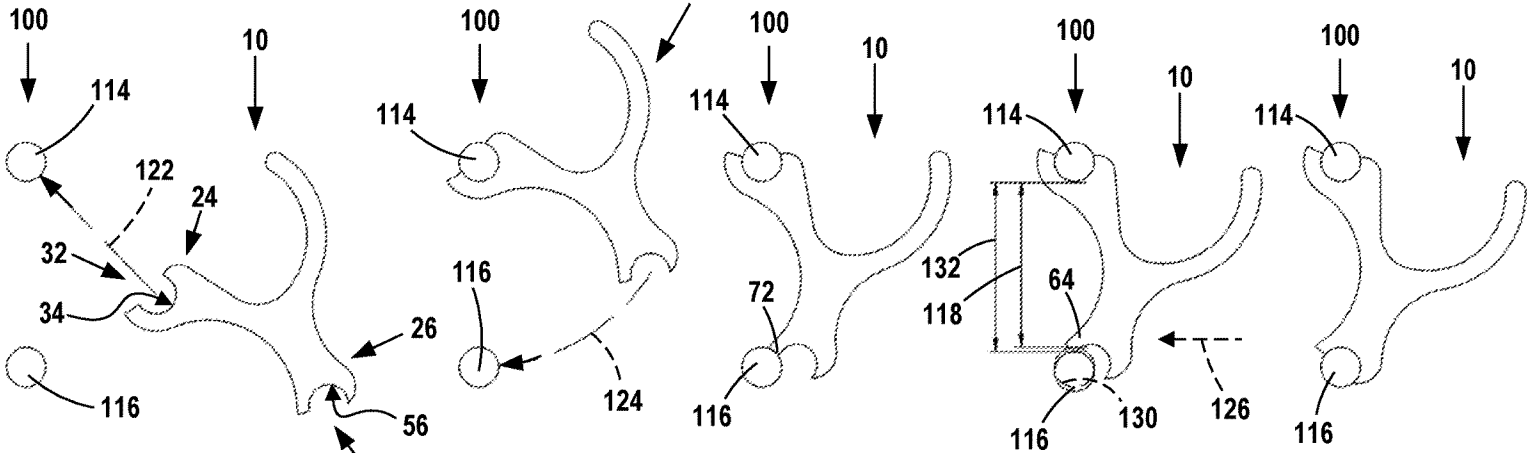
Fig. 6
Fig. 7
Fig. 8
Fig. 9
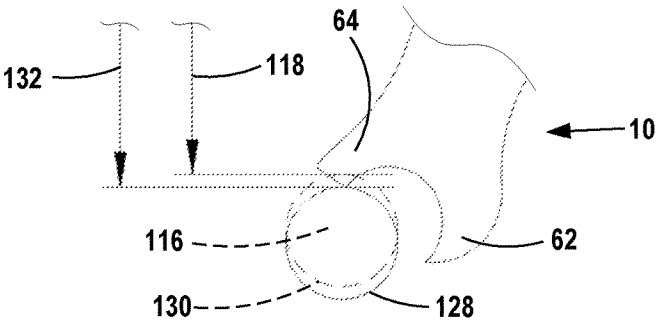
Fig. 10
Fig. 11

SUPPORT FOR WIRE SHELF AND METHOD OF USE

FIELD OF THE DISCLOSURE

The disclosure relates to supports mounted onto wire shelving units, particularly supports having hooks or like engagement features to secure items in place. The disclosed support is adapted to securely and releasably couple to wire members at the front of wire shelving units so that the support does not interfere with use of the shelving unit.

BACKGROUND OF THE DISCLOSURE

Wire shelving units are commonly mounted in closets, wardrobes, workspaces and other locations to provide additional storage options. The units are typically constructed of elongate wire members of stainless steel or a like material that is powder coated, painted or has a like surface finish.

The wire shelving units typically include an upper, planar shelving area made up of a number of wire members and at least two horizontally-oriented wire members that extend along the front portion of the shelving area.

It is known to mount garment hangers, brackets and like accessories to wire shelving units to provide additional storage options. These accessories can interfere with shelving unit use as accessory elements extend into the top shelving area of the unit through gaps between wire members or impede access to the front of the shelving area. Also, existing accessories have multiple-element structures and separate fasteners that require separate fastener tools. This complicates installation and removal of the accessories from a shelving unit.

Thus, there is a need for an improved support adapted for mounting to a wire shelving unit that does not interfere with shelving unit use, may be easily mounted to a shelving unit without the need of additional tools and is simple to manufacture.

SUMMARY OF THE DISCLOSURE

Disclosed is a support and its method of use. The support is adapted to be mounted on the front of wire shelving units and may be used with various engagement elements to provide a user with additional shelving storage options.

The support is easily manufactured having a unitary structure and does not extend into the top shelving area of a shelving unit or impede access to the front of the shelving area. The support may be installed and removed from a wire shelving unit by-hand without the need of additional tools.

The support may be used with a number of item-engagement elements including hooks and posts for supporting clothing, bags and like items. In embodiments the support may provide a flat surface used to mount labels, hooks-and-loops type fastener strips and like accessories.

Other objects and features of the disclosure will become apparent as the description proceeds, especially when taken in conjunction with the accompanying drawing sheets illustrating the support.

DESCRIPTION OF THE DRAWINGS

FIGS. 6 through 10 are representational side views showing the process of installing the support onto a wire shelving unit;

FIG. 11 is a detail view of FIG. 9;

DETAILED DESCRIPTION OF THE INVENTION

Figure 1:
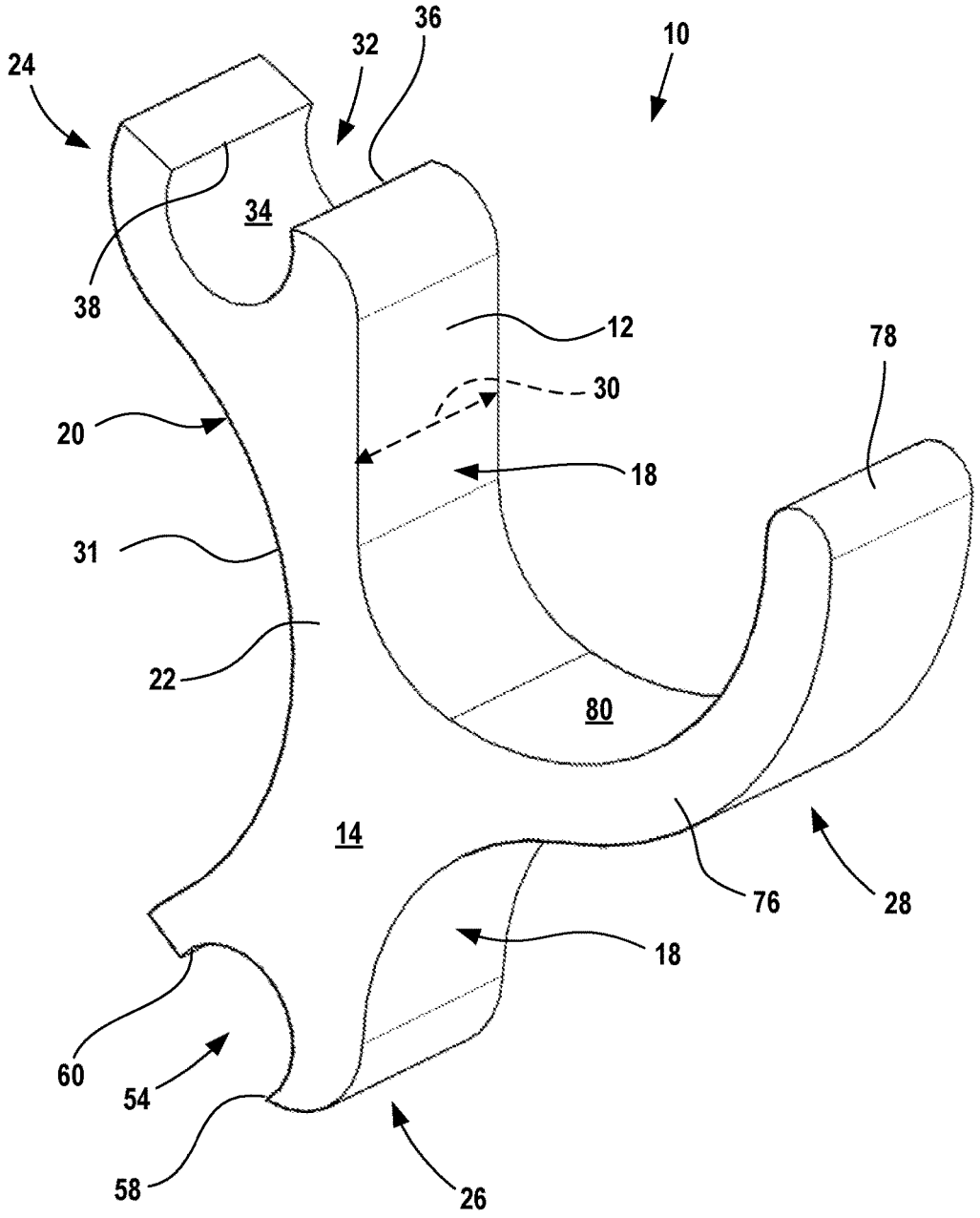
FIG. 1 is a perspective view of the support.

FIG. 1 is a perspective view of a first embodiment support 10.

Support 10 has a unitary body 12 with a body front face 14 and a body rear face 16. Opposed first body side and second body side 20 are located generally horizontally to either side of body column 22. Sides 18, 20 and body column 22 extend generally vertically between body upper portion 24 and body lower portion 26. Item engagement portion 28 extends outwardly from body side 18 and away from body column 22.

Body 12 has a generally uniform thickness 30 extending between body faces 14 and 16.

In embodiments, body 12 may be formed from a rigid material, including plastics, metals or like materials. In certain embodiments, body 12 may be formed from thermoplastic polymers or a polycarbonate material.

Depending on the specific material selected for the formation of body 12, thickness 30 may vary. In embodiments, thickness 30 may be in the range of 10 to 12 millimeters.

Figure 2:
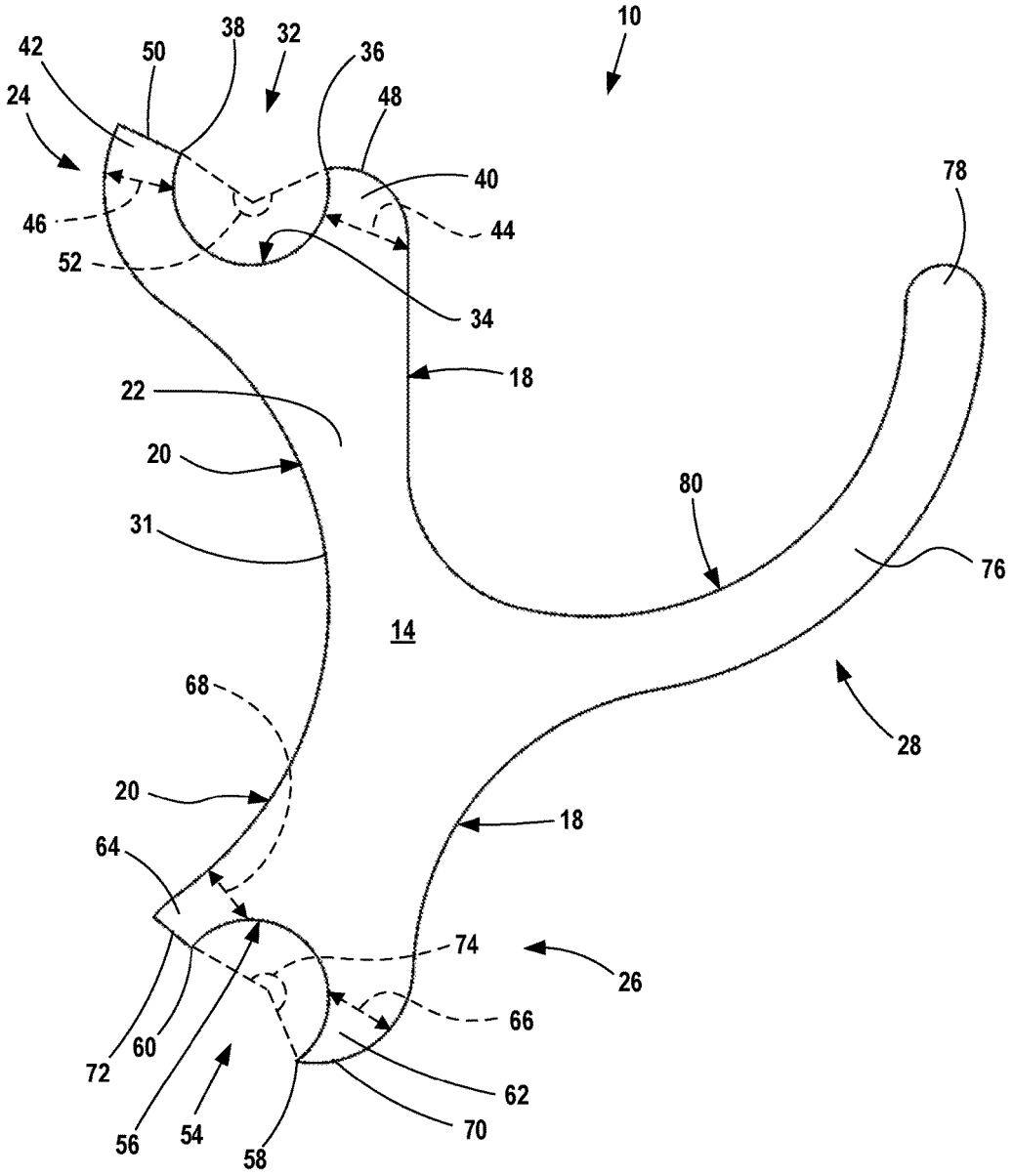
FIG. 2 is a front side view of the support.
Figure 3:
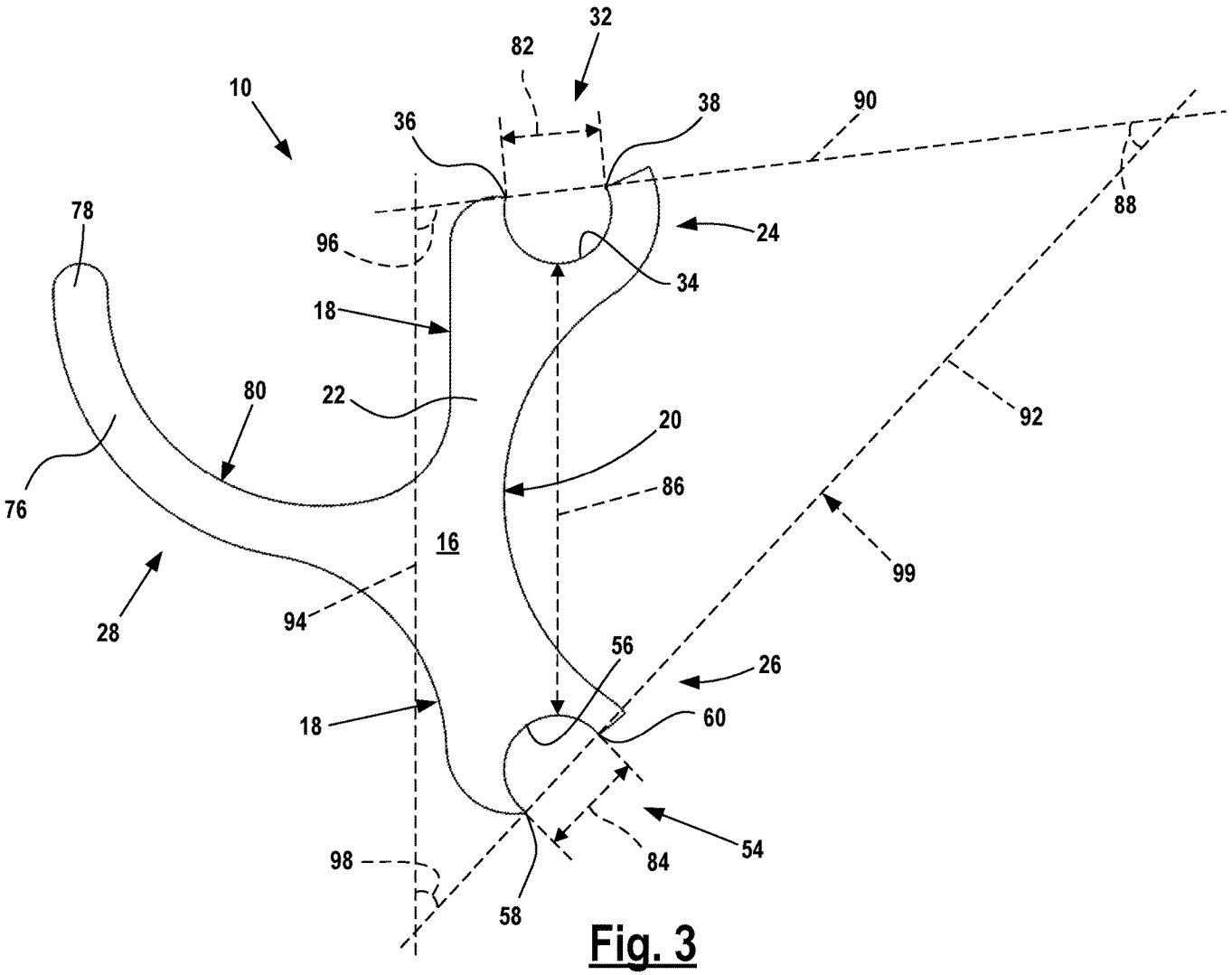
FIG. 3 is a rear side view of the support.

As shown in FIGS. 2 and 3, the front and rear faces 14, 16 are symmetrical, substantially being mirror images of each other.

In embodiments, first body side 20 may have an inward curve 31 extending from body upper portion 24 to the body lower portion 26.

Body upper portion 24 has upper engagement mouth 32 facing generally upwardly and away from support 10. Mouth 32 includes internal upper mouth surface 34 extending from upper mouth first upper corner 36 to upper mouth second upper corner 38.

Upper engagement mouth 32 is located between first and second upper arms 40, 42. First upper arm 40 has an arm thickness 44 extending from upper mouth arc surface 34 to first body side 18. Second upper arm 42 has an arm thickness 46 extending from upper mouth arc surface 34 to second body side 20.

First upper arm 40 may have a curved first upper stop surface 48 extending from first upper corner 36 to first body side 18. Second upper arm 42 may have a flat second upper stop surface 50 extending from second upper corner 38 to second body side 20.

Upper mouth arc surface 34 has an upper mouth arc radius 52 measured from mouth first upper corner 36 to mouth second upper corner 38. Upper mouth arc radius 52 may be at least 180 degrees to allow engagement with a shelfing wire member as explained in greater detail below. In embodiments, upper mouth arc surface 34 has an arc radius 52 of about 219 degrees. In other embodiments, upper mouth arc radius 52 may vary within a range of about 216 degrees to about 222 degrees.

Body lower portion 26 has lower engagement mouth 54 facing generally downwardly and away from support 10. Mouth 54 includes internal lower mouth surface 56 extending from lower mouth first lower corner 58 to lower mouth second lower corner 60.

Lower engagement mouth 54 is located between first and second lower portion arms 62, 64. First lower arm 62 has an arm thickness 66 extending from lower mouth arc surface 56 to first body side 18. Second lower arm 64 has an arm thickness 68 extending from lower mouth arc surface 56 to second body side 20.

First lower arm 62 may have a curved lower first stop surface 70 extending from first lower corner 58 to first body side 18. Second lower arm 64 may have a flat second stop surface 72 extending from second lower corner 60 to second body side 20.

Lower mouth arc surface 56 has a lower mouth arc radius 74 measured from mouth first lower corner 58 to mouth second lower corner 60. Lower mouth arc radius 74 may be at least 180 degrees to allow engagement with a shelfing wire member as explained in greater detail below. In embodiments, lower mouth arc surface 56 has an arc radius 74 of about 194 degrees. In other embodiments, lower mouth arc radius 74 may vary within a range of about 191 degrees to about 197 degrees.

Item engagement portion 28 extends away from body column 22 and first body side 18. Portion 28 includes upwardly facing hook arm 76 extending from body side 18 to curved arm end 78. Arm 76 has an upwardly facing hook arm surface 80 extending from body side 18 to curved arm end 78.

As shown in FIG. 3, upper engagement mouth 32 has an upper engagement mouth opening distance 82 extending between upper corners 36 and 38 and lower engagement mouth 54 has a lower engagement mouth opening distance 84 extending between lower corners 58 and 60. In embodiments, upper mouth opening distance 82 is smaller than lower mouth opening distance 84.

Upper mouth arc surface 34 is separated from lower mouth arc surface 56 by vertically-extending line 86. Line 86 extends generally parallel to body column 22. The length of line 86 generally corresponds to the distance between the upper and lower wire members upon which support 10 is mounted.

As shown in FIG. 3, upper mouth arc surface 34 is angularly offset from lower mouth arc surface 56 by radially turned angle 88. Angle 88 is measured by intersecting line 90 with line 92. Line 90 extends across the opening of upper engagement mouth 32 from mouth first upper corner 36 to mouth second upper corner 38. Line 92 extends across the opening of lower engagement mouth 54 from mouth first lower corner 58 to mouth second lower corner 60.

In embodiments, angle 88 is about 43 degrees. In other embodiments, angle 88 may vary within a range of about 40 degrees to about 46 degrees.

Line 94 is generally parallel to line 86 and intersects lines 90 and 92. Angle 96 is measured at the intersection of lines 90 and 94. Angle 96 is obtuse, being greater than 90 degrees. In embodiments, angle 96 may be about 96 degrees, indicative of line 90 and upper engagement mouth 32 being angularly offset or radially turned in the counterclockwise direction from line 94 and line 86 by about 96 degrees. In other embodiments, angle 96 may vary within a range of about 93 degrees to about 99 degrees.

Angle 98 is measured at the intersection of lines 92 and 94. In embodiments, angle 98 may be about 41 degrees, indicative of line 92 and lower engagement mouth being angularly offset or radially turned in the clockwise direction from line 94 and line 86 by about 41 degrees. In other embodiments, angle 98 may vary within a range of about 38 degrees to about 44 degrees.

Lines 90, 92 and 94 cooperate to form a triangle 99. As shown in FIG. 3, triangle 99 is a scalene triangle wherein the triangle sides corresponding to lines 90, 92 and 94 have different lengths.

Figure 4:
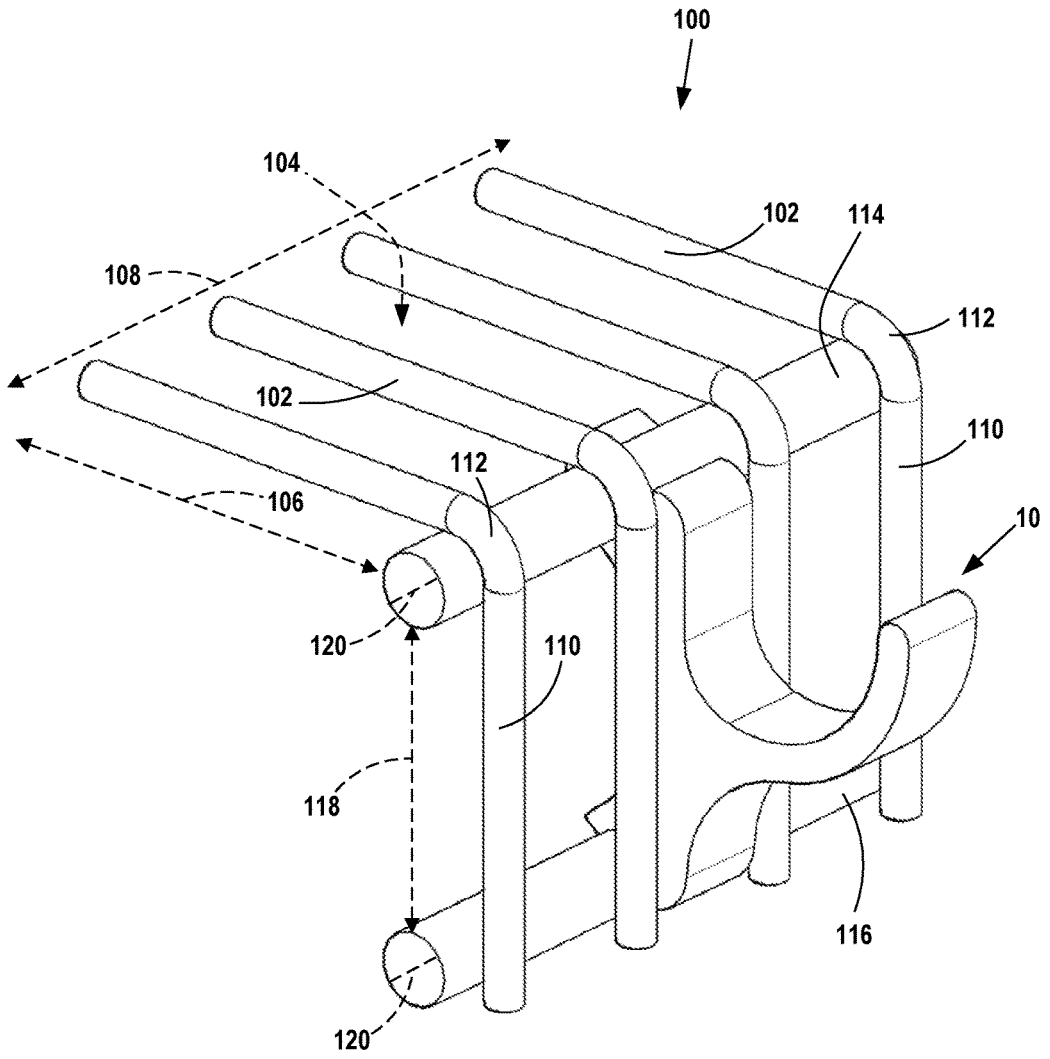
FIG. 4 is a perspective view of the support installed on a wire shelving unit.
Figure 5:
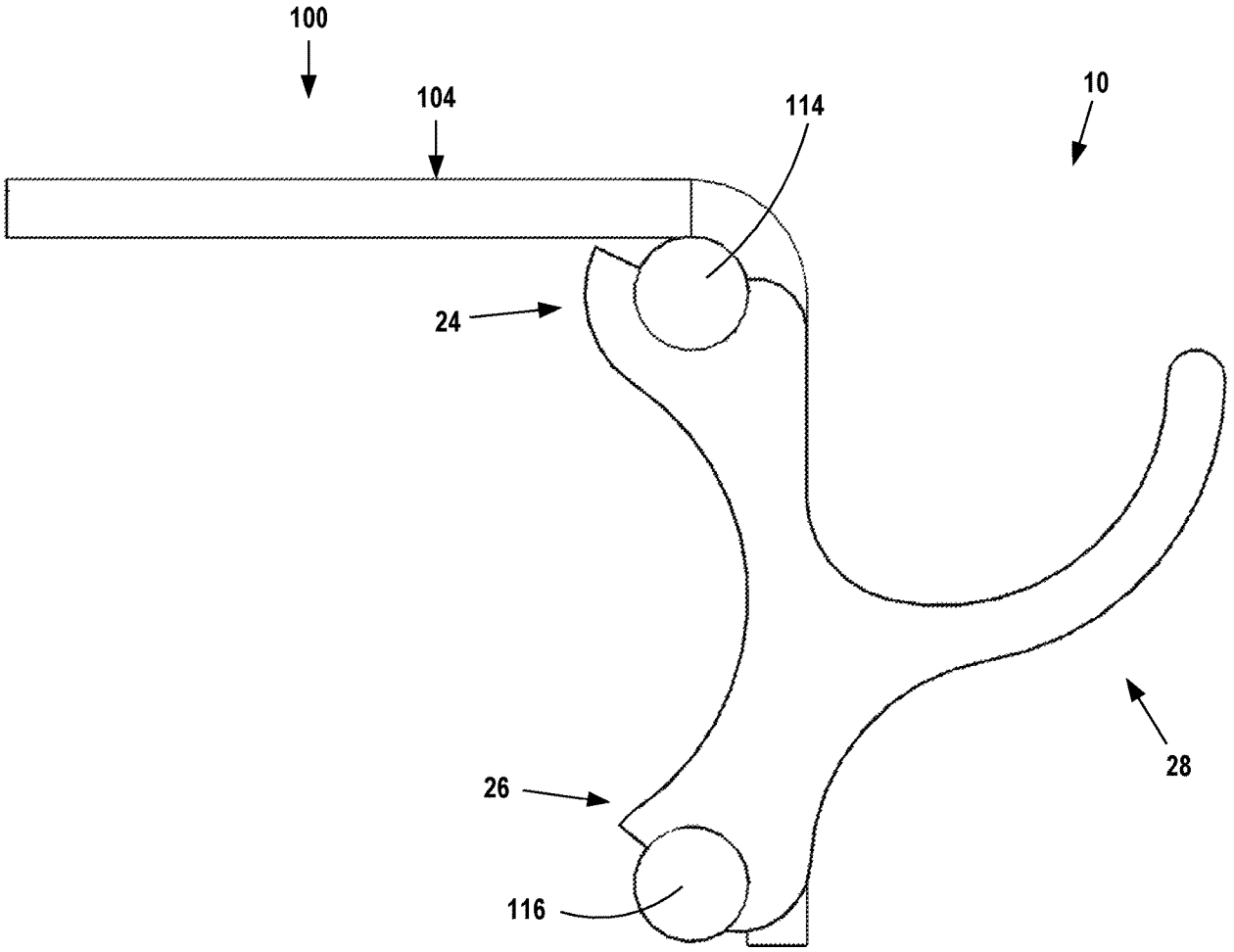
FIG. 5 is a side view of the support installed on a wire shelving unit.

FIGS. 4 and 5 illustrate support 10 installed on a wire shelving unit 100. Unit 100 is made up of a number of wire elements 102 making up a shelving area 104 located in a plane extending between a shelf width 106 and a shelf length 108. Wire elements 102 extend vertically downward from shelving area 104 to form a number of supports 110 located at the front portion 112 of shelving area 104. Supports 110 are joined to horizontally-extending upper and lower wire members 114, 116. Members 114, 116 extend generally parallel to shelf length 108 and to each other along unit front of 112. Members 114, 116 are located a vertically-extending wire member distance 118 from each other. Upper and lower wire members 114, 116 have generally similar, circular cross sectional areas with like diameters 120.

In certain embodiments, the size of upper and lower wire members 114, 116 may be different having dissimilar circular cross sectional areas and diameters.

As best seen in FIG. 5, when support 10 is installed on a wire shelving unit 100, body upper portion 24 does not contact or interfere with use of shelving area 104. Likewise, body lower portion 26 does not interfere with items located below unit 100 and lower wire member 116.

FIGS. 6 through 10 illustrate the process of installing support 10 onto the upper and lower wire members 114, 116 of a wire shelving unit 100.

FIG. 6 shows support 10 located adjacent unit 100 so that upper engagement mouth 32 is moved in the direction of arrow 122 toward upper wire member 114.

FIG. 7 shows upper engagement mouth 32 placed into engagement with upper wire member 114 to that upper mouth arc surface 34 contacts member 114. Support 10 is then rotated in the direction of arrow 124 so that lower engagement mouth 54 is positioned toward lower wire member 116.

FIG. 8 shows support 10 after it is rotated in the direction of arrow 124 so that surface 72 is brought in contact with lower wire member 116.

FIGS. 9 and 11 show support 10 as an additional displacement force is exerted on the support in the direction of arrow 126. The displacement force pushes surface 72 on second lower arm 64 against lower wire member 116. This displaces member 116 downward to a displacement position 128 located below non-displaced position 130.

When lower wire member 116 is in displacement position 128, members 114, 116 are located a distance 132 from each other that is greater than distance 118. The downward displacement of lower wire member 116 allows second lower arm 64 to travel past member 116 as shown in FIGS. 9 and 11. After arm 64 passes member 116, member 116 moves back to non-displaced position 130 and lower engagement mouth 54 engages lower wire member 116 so that lower mouth arc surface 56 contacts member 116 as shown in FIG. 10.

Support 10 is uninstalled from wire shelving unit 100 by reversing the above steps.

Support 10 may be installed and uninstalled from appropriately sized wire shelving units 100 multiple times without the need of additional parts or the use of tools.

When member 10 is in the installed position on a properly sized unit 100, distance 86 between upper mouth arc surface 34 and lower mouth arc surface 56 corresponds to distance 118 between wire members 114 and 116. See FIGS. 3 and 9.

Support 10 can be adapted to fit different shelving units 100 having different distances 118 between wire members 114 and 116. Likewise, support 10 can be adapted to fit different shelving units 100 having wire members 114 and 116 having various circular cross sectional areas of different sizes and different diameters 120.

In alternate embodiments, it is contemplated to form a member 10 having a distance 86 between the upper and lower mouth arc surfaces 34, 56 corresponding to the distance 118 between upper and lower wire members 114, 116. In conventional wire shelving units, distance 118 tends to be in a range of 12 millimeters to 35 millimeters depending on the wire shelf type and specific manufacturer. In other wire shelving units, distance 118 may be other values.

Likewise, in conventional wire shelving units, wire members 114 and 116 tend to have similar circular cross sectional areas corresponding to diameters 120 in the range of 5 millimeters to 10 millimeters. In alternate embodiments, it is contemplated to form a member 10 having upper and lower mouths with corresponding arc surfaces sized to properly engage wire members 114 and 116 having a variety of wire diameters 120.

Figure 12:
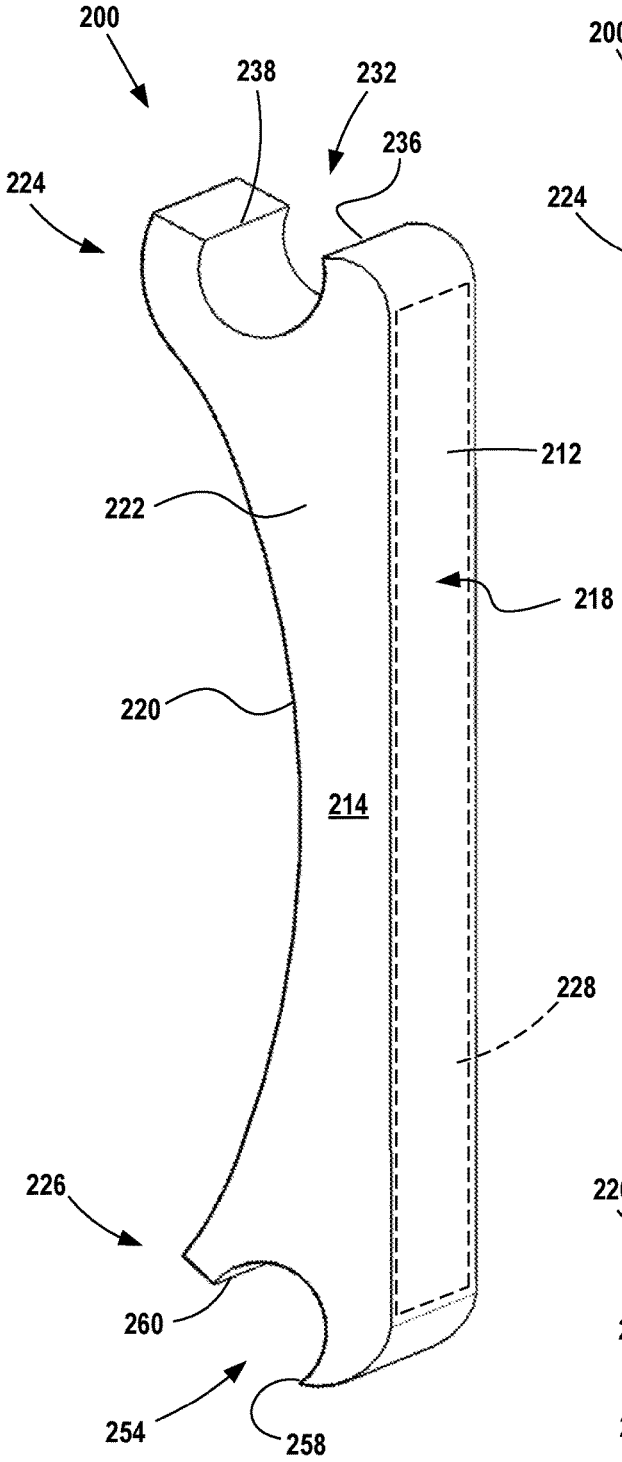
FIG. 12 is a perspective view of a second embodiment support.
Figure 13:
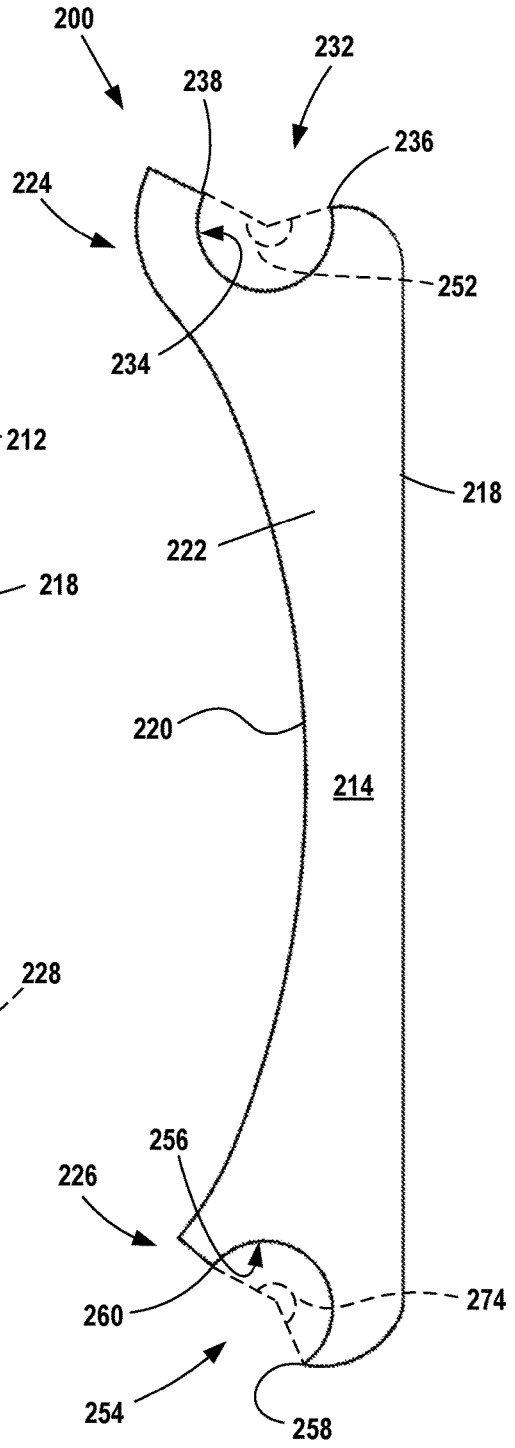
FIG. 13 is a front side view of the second embodiment support.

FIG. 12 is a perspective view of a second embodiment support 200.

Support 200 is similar to above-described support 10, having a unitary body 212 with a body front face 214 and a body rear face 216. Opposed first body side 218 and second body side 220 are located to either side of body column 222. Sides 218, 220 and body column 222 extend between body upper portion 224 and body lower portion 226.

A difference between support 200 and support 10 is that support 200 does not include an item engagement portion extending outwardly from first body side 218. Instead, first body side 218 includes a flat mounting area 228. Area 228 extends along of side 218 between faces 214, 216. Area 228 may be used for attaching identifying labels, magnets, hooks and loops type strips and other accessories to support 200 by use of conventional tape or other adhesives.

Another difference between support 200 and support 10 is that support 200 is configured to be installed on a wire shelving unit having different physical dimensions than above-described wire shelving unit 100. In particular, body column 222 is longer than column 22 so that support 200 may be installed on a wire shelving unit having a greater distance between upper and lower wire members upon which the support is mounted. Additionally, support 200 upper and lower mouths are sized to engage wire members having different diameters than wire diameters 120 shown in wire shelving unit 100.

Support 200 body upper portion 224 has upper engagement mouth 232 facing generally upwardly and away from support 200. Mouth 232 is generally similar to above-disclosed mouth 32, having an internal upper mouth surface 234 extending from mouth first upper corner 236 to mouth second upper corner 238.

Upper mouth arc surface 234 has an arc radius 252 measured from mouth first upper corner 236 to mouth second upper corner 238. Arc radius 252 is generally similar to above-disclosed arc radius 52.

Body lower portion 226 has lower engagement mouth 254 facing generally downwardly and away from support 200. Mouth 254 is generally similar to mouth 54 and includes internal lower mouth surface 256 extending from mouth first lower corner 258 to mouth second lower corner 260.

Lower mouth arc surface 256 has an arc radius 274 measured from mouth first lower corner 258 to mouth second lower corner 260. Arc radius 274 is generally similar to above-disclosed arc radius 74.

Figure 14:
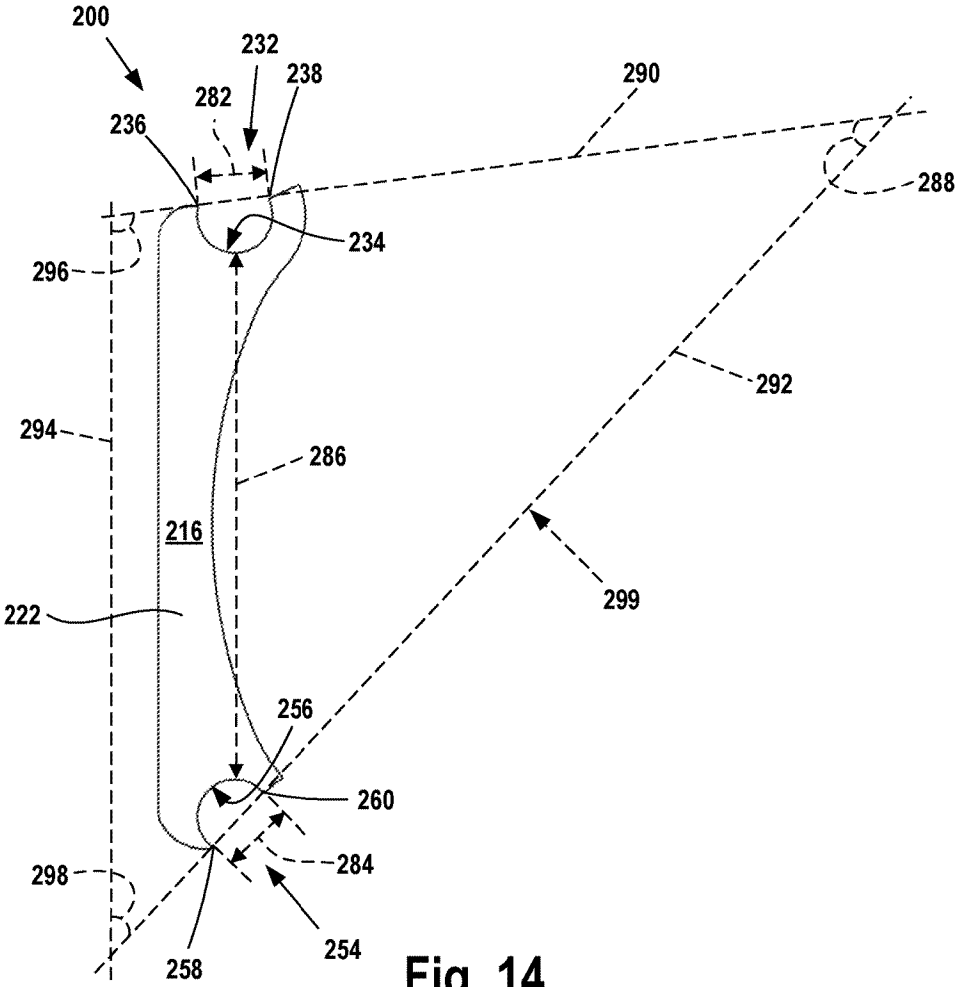
FIG. 14 is a rear side view of the second embodiment support.

As shown in FIG. 14, upper engagement mouth 232 has an upper engagement mouth opening distance 282 extending between upper corners 236 and 238 and lower engagement mouth 254 has a lower engagement mouth opening distance 284 extending between lower corners 258 and 260. In embodiments, upper mouth opening distance 282 is smaller than lower engagement mouth opening distance 284.

Upper mouth arc surface 234 is separated from lower arc surface 256 by vertically-extending line 286. Line 286 extends generally parallel to body column 222. The length of line 286 generally corresponds to the distance between the upper and lower wire members upon which support 200 is mounted.

Line 294 is generally parallel to line 286 and intersects lines 290 and 292. Angle 296 is measured at the intersection of lines 290 and 294. Angle 296 is obtuse, being greater than 90 degrees. In embodiments, angle 296 may be about 96 degrees, indicative of line 290 and upper engagement mouth 232 being angularly offset or radially turned in the counterclockwise direction from line 294 and line 286 by about 96 degrees. In other embodiments, angle 96 may vary within a range of about 93 degrees to about 99 degrees.

Angle 298 is measured at the intersection of lines 292 and 294. In embodiments, angle 298 may be about 41 degrees, indicative of line 292 and lower engagement mouth 254 being angularly offset or radially turned in the clockwise direction from line 294 and line 286 by about 41 degrees. In other embodiments, angle 298 may vary within a range of about 38 degrees to about 44 degrees.

Lines 290, 292 and 294 cooperate to form a triangle 299. As shown in FIG. 14, triangle 299 is a scalene triangle wherein the triangle sides corresponding to lines 290, 292 and 294 have different lengths.

Figure 15:
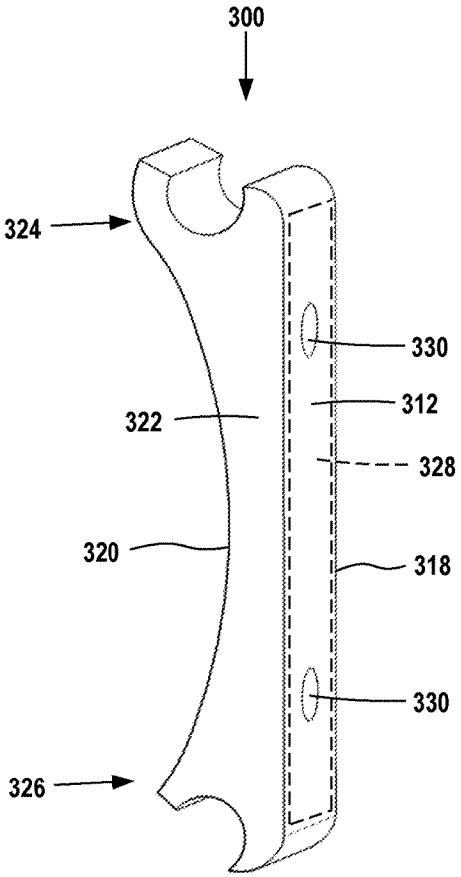
FIG. 15 is a perspective view of a third embodiment support.

FIG. 15 is a perspective view of a third embodiment support 300.

Support 300 is similar to above-described support 200, having a unitary body 312. Opposed first body side 318 and second body side 320 are located to either side of body column 322. Sides 318, 320 and body column 322 extend between body upper portion 324 and body lower portion 326.

A difference between support 300 and support 200 is that side 318 flat mounting area 328 includes mounting apertures 330. Apertures 330 may be used to attach various accessories to support 300 including removable hooks, posts of other support apparatuses extending outwardly from side 318. While apertures 330 are shown as round, other shaped apertures are also contemplated including square and elongate channel shaped apertures.

Figure 17:
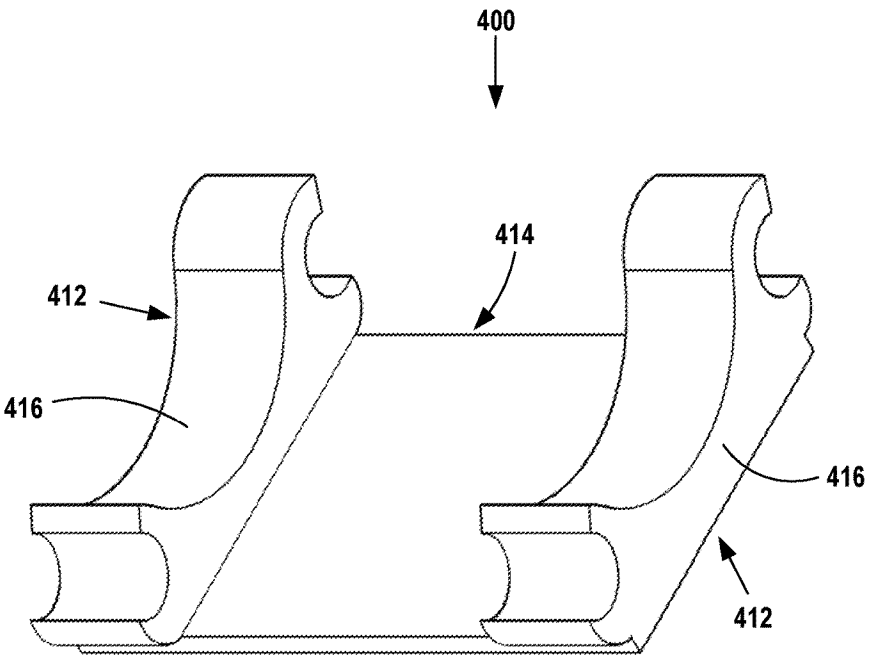
FIGS. 16 and 17 are perspectives view of a fourth embodiment support.
Figure 16:
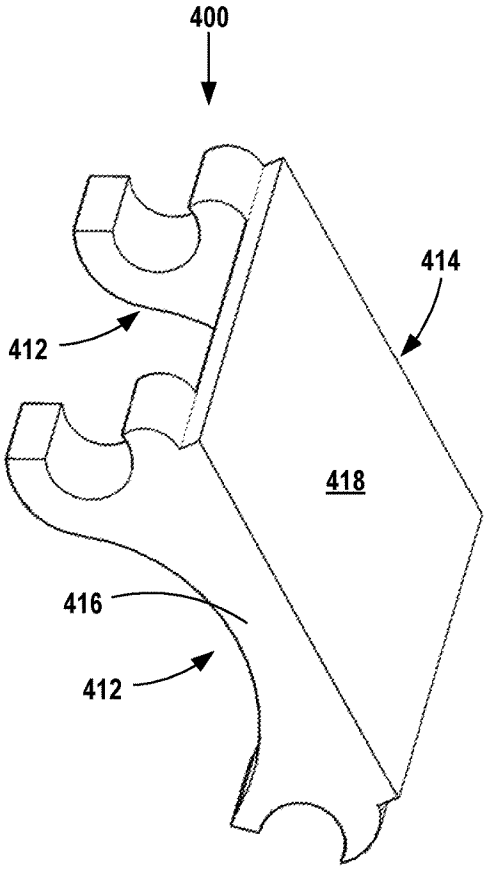

FIGS. 16 and 17 are perspective views of a fourth embodiment support 400.

Support 400 includes two unitary bodies 412, each similar to above-disclosed body 212. Bodies 412 are attached to mounting plate 414 which is joined to the body column 416 of each body. Plate 414 includes a flat mounting area 418. Area 418 may be used for attaching identifying labels, magnets, hooks and loops type strips and other accessories to support 400 by use of conventional tape or other adhesives.

FIGS. 18 through 27 illustrate a number of alternate embodiment supports.

Figure 18:
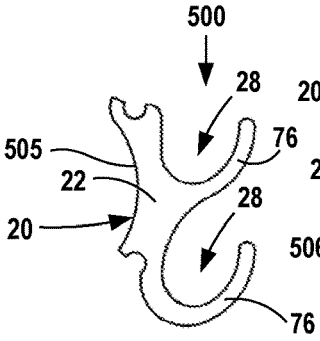
FIGS. 18 through 27 are side views of alternate embodiment supports.
Figure 19:
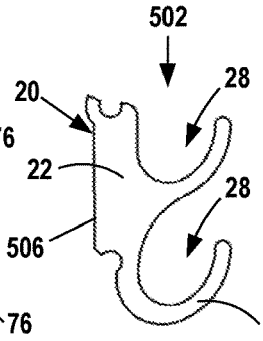
Figure 20:
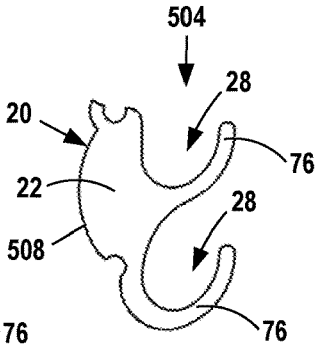

FIGS. 18 through 20 illustrate supports 500, 502 and 504 having two engagement portions 28 extending away from the same side of body column 22 with one engagement portion located above the other. As shown in the figures, engagement portions 28 are upwardly facing hook arms 76. Support 500 body side 20 has an inward curve 505 like inward curve 31 disclosed above. Support 502 body side 20 has an flat side 506 extending along body column 22. Support 504 body side 20 has an outward curve 508 extending along body column 22.

Figure 21:
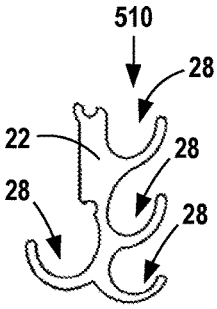

FIG. 21 illustrates a support 510 having four engagement portions 28, three extending away from one side of body column 22, and one extending away from the other side of body column 22.

Figure 22:
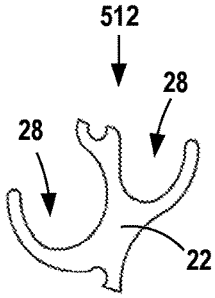

FIG. 22 illustrates a support 512 having two engagement portions 28 extending away from opposed sides of body column 22.

Figure 23:
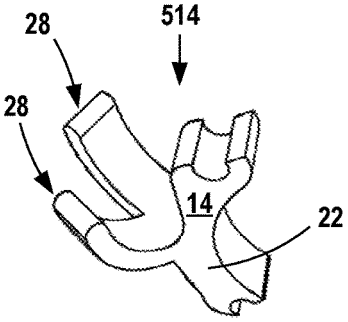

FIG. 23 illustrates a support 514 having two engagement portions 28 extending away from body column 22 and in planes extending outwardly from body faces 14 and 16.

Figure 24:
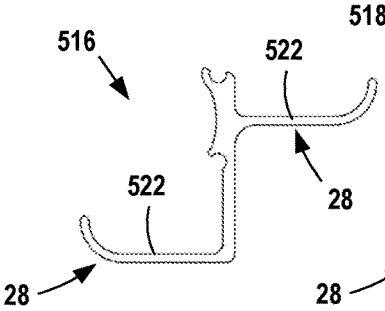
Figure 25:
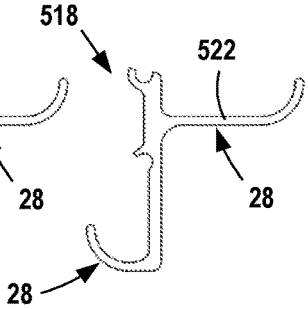
Figure 26:
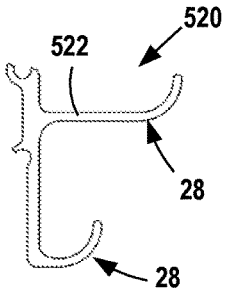

FIGS. 24 through 26 illustrate supports 516, 518 and 520 having engagement portions 28 including upwardly facing elongate hook arms 522.

Figure 27:
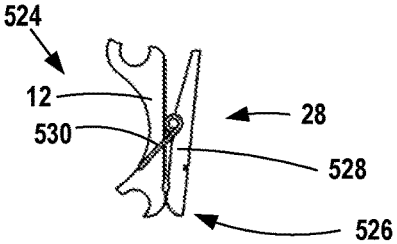

FIG. 27 illustrates a support 524 having an engagement portion 28 having a clothespin engagement portion 526. Clothespin engagement portion 526 has an engagement prong 528 biased against support body 12 by a spring 530.

While one or more embodiments have been disclosed and described in detail, it is understood that this is capable of modification and that the scope of the disclosure is not limited to the precise details set forth but includes modifications obvious to a person of ordinary skill in possession of this disclosure and also such changes and alterations as fall within the purview of the following claims.

The invention claimed is:

1. A support comprising:

a body having a body column, body first and second sides located on opposed sides of the body column, the column and sides extending between a body upper portion and a body lower portion, a generally uniform body thickness extending between a body front face and a body rear face;

the body upper portion having an upper engagement mouth located between a first upper portion arm and a second upper portion arm, the upper engagement mouth having an upper engagement mouth opening distance extending between a first upper corner on the first upper portion arm and a second upper corner on the second upper portion arm and an upper mouth arc surface extending from the first upper corner to the second upper corner;

the body lower portion having a lower engagement mouth located between a first lower portion arm and a second lower portion arm, the lower engagement mouth having a lower engagement mouth opening distance extending between a first lower corner on the first lower portion arm and a second lower corner on the second lower portion arm and a lower mouth arc surface extending from the first lower corner to the second lower corner;

the upper mouth arc surface having an upper mouth arc radius, the lower arc surface having a lower mouth arc radius, the upper mouth arc radius greater than the lower mouth arc radius.

2. The support of claim 1 wherein the upper engagement mouth opening distance is smaller than the lower engagement mouth opening distance.

3. The support of claim 2 wherein the upper mouth arc radius is about 219 degrees and the lower mouth arc radius is about 194 degrees.

4. The support of claim 3 wherein the upper mouth arc surface is angularly offset from the lower mouth arc surface by a radially turned angle of about 43 degrees.

5. The support of claim 4 wherein the body comprises an item engagement portion extending away from the body column.

6. The support of claim 5 wherein the upper mouth arc surface is a continuous curved surface extending between the first upper corner and the second upper corner.

7. The support of claim 6 wherein the lower mouth arc surface is a continuous curved surface extending between the first lower corner and the second lower corner.

8. The support of claim 1 wherein the first upper portion arm has a first upper stop surface extending from the first body side to the first upper corner and a second upper stop surface extending from the second body side to the second upper corner and the first lower portion arm has a first lower stop surface extending from the first body side to the first lower corner and a second lower stop surface extending from the second body side to the second lower corner.

9. A support comprising a body having a front face, a rear face, a generally uniform body thickness extending between the front face and the rear face, a body upper portion, a body lower portion, opposed first and second body sides, a body column extending from the lower portion to the upper portion between the first and second body sides, the upper portion having an upper engagement mouth, the upper engagement mouth having an upper engagement mouth arc surface extending from an upper mouth first corner to an upper mouth second corner and an upper engagement mouth opening distance extending between the upper mouth first corner and the upper mouth second corner, the upper engagement mouth arc surface having an upper mouth arc radius greater than 180 degrees, the lower portion having a lower engagement mouth, the lower engagement mouth having a lower engagement mouth arc surface extending from a lower mouth first corner to a lower mouth second corner and a lower engagement mouth opening distance extending between the lower mouth first corner and the lower mouth second corner, the lower arc surface having a lower mouth arc radius greater than 180 degrees, the upper mouth arc radius greater than the lower mouth arc radius.

10. The support of claim 9 wherein the upper mouth arc surface is a continuous curved surface extending between the first upper corner and the second upper corner and the lower mouth arc surface is a continuous curved surface extending between the first lower corner and the second lower corner.

11. The support of claim 10 wherein the upper mouth arc radius is about 219 degrees.

12. The support of claim 11 wherein the lower mouth arc radius is about 194 degrees.

13. The support of claim 12 wherein the body comprises an item engagement portion extending away from the body column.

14. The support of claim 13 wherein the first upper portion arm has a first upper stop surface extending from the first body side to the first upper corner, the second upper portion arm has a second upper stop surface extending from the second body side to the second upper corner, the first lower portion arm has a first lower stop surface extending from the first body side to the first lower corner and the second lower portion arm has a second lower stop surface extending from the second body side to the second lower corner wherein the second upper stop surface and second lower stop surface are generally flat.

15. A method of installing a support onto a wire shelving unit comprising the steps of:

A. Providing a wire shelving unit the wire shelving unit having a shelving area with a width and a length extending perpendicularly to the width, a front portion having upper and lower wire members extending along the length, the upper wire member spaced apart from the lower wire member by vertically-extending wire member distance, the wire member distance extending generally perpendicular to the shelving area, the upper and lower wire members being generally rigid and having a generally circular cross sectional shape;

B. Providing a support comprising a body, the body having opposed first and second body sides, a body column located generally between the body sides and extending from a body lower portion to a body upper portion, the body upper portion having an upper engagement mouth located between a first upper portion arm and a second upper portion arm, the body lower portion having a lower engagement mouth located between a first lower portion arm and a second lower portion arm, the upper engagement mouth comprising an upper mouth arc surface extending between a first upper corner on the first upper portion arm and a second upper corner on the second upper portion arm, the upper mouth arc surface having an arc radius the lower engagement mouth comprising a lower mouth arc surface extending between a first lower corner on the first lower portion arm and a second lower corner on the second lower portion arm, the lower arc surface having an arc radius greater than the lower mouth arc radius, the second lower portion arm comprising a stop surface extending from the second body side to the second lower corner;

C. Locating the upper engagement mouth proximate the upper wire member and locating the lower engagement mouth proximate the lower wire member;

D. Placing the upper mouth arc surface in contact with the upper wire member;

E. Rotating the support about the upper wire member so that the second lower portion arm stop surface contacts the lower wire member;

F. Exerting a force on the support so that the second lower portion arm stop surface moves the lower wire member downward from its original position; and G. Continuing to rotate the support about the upper wire member so that the lower mouth arc surface comes into contact with the lower wire member and the second lower portion arm stop surface ceases displacement of the lower wire member so that the lower wire member moves upward toward its original position.

16. The method of claim 15 wherein the upper mouth arc radius is about 219 degrees.

17. The method of claim 16 wherein the lower mouth arc radius is about 194 degrees.

18. The method of claim 17 wherein the body comprises an item engagement portion extending away from the body column.

19. The method of claim 18 wherein the upper mouth arc surface and lower mouth arc surface are continuous curved surfaces.

20. The method of claim 15 further comprising the step of:

H: Orienting the upper mouth arc surface on the upper wire member so that the body upper portion does not contact the shelving area.

* * * * *